US005467083A

United States Patent [19]

McDonald et al.

[11] Patent Number: 5,467,083

[45] Date of Patent: Nov. 14, 1995

[54] WIRELESS DOWNHOLE ELECTROMAGNETIC DATA TRANSMISSION SYSTEM AND METHOD

[75] Inventors: William J. McDonald; Gerard T. Pittard; Charles G. Steele, all of Houston; Karl F. Kiefer, The Woodlands; Terry P. Clifton; Curtis E. Leitko, both of Houston, all of Tex.

[73] Assignee: Electric Power Research Institute, Palo Alto, Calif.

[21] Appl. No.: 111,915

[22] Filed: Aug. 26, 1993

[51] Int. Cl.[6] ..... G01V 1/40

[52] U.S. Cl. ..... 340/854.6; 340/854.4

[58] Field of Search ..... 367/81, 82; 340/853.1, 340/853.6, 853.8, 854.4, 854.5, 854.6, 855.5; 324/333, 335, 338

[56] References Cited

U.S. PATENT DOCUMENTS 4,739,325 4/1988 MacLeod ..... 340/854.6
5,264,795 11/1993 Rider ..... 324/326

OTHER PUBLICATIONS

McDonald et al, "Accunav, Remote Guidance For Directional Boring," 1992 No–Dig International Conference, Washington, D.C. Apr. 20–24, 1992.

*Primary Examiner*—Ian J. Lobo
*Attorney, Agent, or Firm*—Neal J. Mosely

[57] ABSTRACT

A wireless downhole electromagnetic data transmission system and method utilizes microprocessor controlled frequency synthesis for two-way communication between the surface and a downhole guided boring or drilling apparatus in the range of from 100 Hz to 100 KHz. A non-magnetic downhole probe unit connected between a drill motor or drill bit and the drill string contains data gathering and transmission components including accelerometers which measure the earth's gravity vector and fluxgate magnetometers which read the earth's magnetic field and serve as power line proximity sensors. The drill pipe acts as an electrical lossy, single conductor with the earth forming the electrical return path. Sensory data gathered by the downhole probe is encoded in digital format and impressed upon the drill string using frequency shift keying of the electromagnetic energy waves and is picked off at the surface by a signal receiver-demodulator and message processor unit. The surface unit instructs the downhole probe to transmit multiple frequencies and selects one or more frequencies with the most favorable signal-to-noise ratio(s) in response to local conditions to maximize the transmission distance at a selective frequency band range and given transmitter power level and baud rate. The received signal is filtered, demodulated, processed and displayed at the surface and gravity and magnetic field vectors are combined with the created hole length to calculate x, y, and z hole coordinates and derive hole position vectors.

41 Claims, 9 Drawing Sheets

IMPEDANCE MEASUREMENT CIRCUIT

MAGNETIC PROXIMITY DETECTION CIRCUIT

WIRELESS DOWNHOLE ELECTROMAGNETIC DATA TRANSMISSION SYSTEM AND METHOD

BACKGROUND OF THE INVENTION

1. Field of the Invention

This invention relates generally to data communication systems for guided boring and drilling apparatus, a data acquisition and data link system for any information, uphole or downhole, and more particularly to a wireless downhole electromagnetic data transmission system utilizing microprocessor controlled frequency synthesis for two-way communication between the surface and a downhole guided boring or drilling apparatus wherein the system selects one or more frequencies in the range from 15 Hz to 100 kHz having an optimum signal-to-noise ratio at a given transmitter power level and baud rate.

2. Brief Description of the Prior Art

Since its inception into the underground utility construction industry, guided boring technology has experienced rapid advances and evolution in the types of systems available and the range and accuracies that can be achieved. Guided boring requires the capability to control hole direction and monitor its position in space. Currently, most small guided boring systems such as rod pushers, wet bore, and compaction systems utilize "pipe locators" to track and orient the boring head. These "pipe locators" consist of a small active transmitter placed near the drill head and a pair of highly tuned receiver coils. The devices are low cost and provide reasonably accurate data. Their main limitations are the need for surface access and shallow depth capability. Conventional "pipe locator-based tracking systems" have become more difficult and impractical to employ in areas with difficult access and at increased depths. In addition, the risk of depending on the interpretive nature of "pipe-locators" and the incomplete information they provide grows less acceptable in direct relation to overall job costs.

Solid-state compasses known as "steering tools" are used for tracking and guidance of boring tools when economics and work conditions allow. These "steering tools" are significantly more expensive than "pipe locators" and require an insulated wire connecting the downhole instrumentation to the surface.

More recently, wireless systems, referred to generically as "Measurements-While-Drilling (MWD) systems have been developed. The MWD systems provide wellbore directional data and/or formation without requiring an insulated hardwire link to bring information to the surface. The wireless, "Measurements-While-Drilling" (MWD) systems provide higher reliability, simpler operation, higher speed, greater directional control, longer distances; and accommodate a greater range of hole sizes. The cost savings, minimum surface disruption, miniaturization, and ability to provide the drilling contractor with real-time information of bottomhole conditions, has made MWD technology especially useful in the utilities industry.

Electromagnetic systems operating under crystal controlled frequency generators are known which operate with one (pulse-width modulation) or two (frequency shift keying (FSK) fixed signals of low frequency, typically less than 25 hertz. These low frequencies are used because of the reduction in signal attenuation with decreasing frequency. A substantial limitation of the prior art electromagnetic systems is the maximum data rate that can be achieved and their nonadaptive nature relative to avoiding interference in the capture frequency band being used.

Directional boring systems require a physical means to change the direction of hole travel in a predictable manner and a method for tracking hole position in space. The position and direction of the drill bit is fully specified in six degrees of freedom: x, y and z coordinates, azimuth, inclination and tool face. In practice, the location and direction instrumentation measuring systems do not make direct measurements of all of these variables. Rather, a sufficient number of readings are made which combined with other data, such as the amount of pipe in the hole, can be used to calculate the remaining variables. For example, "pipe-locators" provide depth, plan location and tool face. Azimuth and inclination must be found by interpolation between the survey points. The accuracy of this interpolation depends on how closely spaced the readings are taken relative to the actual tool path. Similarly, "steering tools" and other compass-type systems measure the three rotation angles in drilling. This information is combined with drilled distance to compute the x, y, and z coordinates.

It is important to understand the differences in capabilities and operating requirements between guidance systems used in "oil and gas well boring" (energy exploration) and those used in "utility boring". With respect to accuracy, "utility boring" requires greater resolution and more frequent surveys to maintain the proper path. This is due in large part to the shallow depths and highly congested environment in which they operate. With respect to packaging, "utility boring" systems must be shorter in length and usually smaller in diameter. Due to the lower values of pressure, temperature, torque, and bit weight in "utility boring" the problems associated with downsizing are more easily overcome than in "oil and gas well boring". It is also important to note that the utility market cannot bear the daily rental rates or purchase costs normally required by oil and gas directional boring service companies.

The use of electromagnetic telemetry systems is well documented. Rubin (U.S. Pat No. 4,725,837) discloses the use of a toroidal coupled telemetry system in which the secondary winding comprises a plurality of turns wrapped around a generally annular core member. The present invention differs from Rubin in that the digital data, transmitted with a frequency shift keying encoding scheme, is injected directly into the drill string—earth conduction path with no reliance on coil induction. This results in a substantially simpler design that is easier and lower in cost to produce.

Further, Rubin et al., (U.S. Pat. No. 4,691,203) describe use of an insulated gap sub composed of conductive sleeves heat shrunk onto an insulated sleeve and a central mandrel. This differs from the present invention which obtains the required insulating qualities without sacrificing strength of the outside collar that must transmit torque and axial loads developed during the drilling process. The current invention places a split, conductive ring over the mandrel in a keyed arrangement. A coating, such as polyurethane is placed between the two elements to achieve electrical insulation. Unlike Rubin et al., the coating is not required to transmit energy—resulting in a mechanically more robust design.

Van Steenwyck (U.S. Pat. No. 5,130,706) describes an apparatus comprising a direct switching element (e.g., magnetic reed switch) for coupling transmission energy from a downhole energy source to the earth-drill string system. The switching element can be used to control the time duration, wave shape or frequency of the output energy to be transmitted. By contrast, the present invention uses a frequency synthesizer to encode the telemetered data in a FSK format.

The synthesizer uses countdown registers to generate two selected frequencies. One frequency is transmitted to represent a logic one and the other frequency is transmitted to represent a logic zero. The logic level signals are used to control transistors which switch the battery pack on and off.

The present invention has been under development for some time and an early experimental version was presented at the 1992 NO-DIG International Conference in Washington, D.C. on Apr. 20–24, 1992, and a paper entities ACCUNAV™, REMOTE GUIDANCE FOR DIRECTIONAL BORING was presented describing this early development work.

The present invention is distinguished over the prior art in general, and these patents in particular by a wireless downhole electromagnetic data transmission system and method utilizing microprocessor controlled frequency synthesis for two-way communication between the surface and a downhole guided boring or drilling apparatus in the range of from 100 Hz to 100 kHz. A nonmagnetic downhole probe unit connected between a drill motor or drill bit and the drill string contains data gathering and transmission components including accelerometers which measure the earth's gravity vector and fluxgate magnetometers which read the earth's magnetic field and serve as power line proximity sensors. A non-magnetic housing, however, may be used in applications where no magnetometer is being used. The apparatus may also be used in near-bit measurements. The drill pipe acts as an electrical lossy, single conductor with the earth forming the electrical return path. Sensory data gathered by the downhole probe is encoded in digital format and impressed upon the drill string using frequency shift keying of the electromagnetic energy waves and is picked off at the surface by a signal receiver-demodulator and message processor unit. The surface unit instructs the downhole probe to transmit multiple frequencies and selects one or more frequencies with the most favorable signal-to-noise ratio(s) in response to local conditions to maximize the transmission distance at a selective frequency band range and given transmitter power level and baud rate. The received signal is filtered, demodulated, processed and displayed at the surface and gravity and magnetic field vectors are combined with the created hole length to calculate x, y, and z hole coordinates and derive hole position vectors.

SUMMARY OF THE INVENTION

It is therefore an object of the present invention to provide a downhole electromagnetic data transmission system for guided boring or drilling apparatus utilizing microprocessor controlled frequency synthesis for two-way communication between the surface and a downhole guided boring or drilling apparatus wherein the system selects one or more frequencies in the range of from 15 Hz to 100 kHz.

It is another object of the present invention to provide a downhole electromagnetic data transmission system for guided boring or drilling apparatus utilizing microprocessor controlled frequency synthesis to maximize the transmission distance at a selective frequency band range and given transmitter power level and baud rate.

It is another object of this invention to provide a downhole electromagnetic data transmission system for guided boring or drilling apparatus which does not require an insulated hard-wire link to bring wellbore directional data and/or formation data to the surface.

Another object of this invention is to provide a downhole electromagnetic data transmission system for guided boring or drilling apparatus utilizing microprocessor controlled frequency synthesis to transmit multiple frequencies and subsequently select one or more frequencies with the most favorable signal-to-noise ratio(s) in response to local conditions to maximize the transmission distance at a selective frequency band range and given transmitter power level and baud rate.

Another object of this invention is to provide a downhole electromagnetic data transmission system for guided boring or drilling apparatus utilizing microprocessor controlled frequency synthesis which can be activated at start-up or at any time during operation.

Another object of this invention is to provide a downhole electromagnetic data transmission system for guided boring or drilling apparatus which is highly reliable in operation and directional control and has a high data transmission speed over long distances, and can accommodate a large range of hole sizes.

A further object of this invention is to provide a compact downhole electromagnetic data transmission system for guided boring or drilling apparatus which is particularly useful in the utilities industry to transmit real-time information regarding boring head orientation and hole trajectory and conditions in an easy to use format with a minimum of surface disruption and substantial cost savings.

A still further object of this invention is to provide a downhole electromagnetic data transmission system for guided boring or drilling apparatus which does not require special operating personnel.

Another object of this invention is to provide a downhole electromagnetic data transmission system which will detect the presence of energized AC and DC power cables located in the immediate vicinity of the boring head and to warn the equipment operators of this potentially dangerous situation.

A still further object of this invention is to provide a downhole electromagnetic data transmission system having a mechanically improved design for injecting transmitted electromagnetic data signals into the earth to complete the drill string-earth coupled transmission path.

A further object of this invention is to provide a simple, reliable downhole data transmission system for measuring the earth's electrical impedance which is useful in selecting the most effective transmitting frequencies and/or maximizing battery life by changing update rates.

A further object of this invention is to provide a simple, reliable downhole data transmission system for determining significant changes in soil or rock types as well as fluid contacts.

Another object of this invention is to provide a downhole electromagnetic data transmission system utilizing an automatic gain control circuit which increases the received signal to a useful level while preventing signal overload. This maximizes the effective transmission distance while preventing receiver saturation at close distances.

A still further object of this invention is to provide a downhole electromagnetic data transmission system utilizing special shock absorbing materials to protect the downhole sensors from damage caused by vibration and shock loads generated by the drilling process while maintaining the required mechanical rigidity for accurate measurements to be taken.

Other objects of the invention will become apparent from time to time throughout the specification and claims as hereinafter related.

The above noted objects and other objects of the invention are accomplished by a wireless downhole electromagnetic data transmission system and method which utilizes microprocessor controlled frequency synthesis for two-way communication between the surface and a downhole guided boring or drilling apparatus in the range of from 15 Hz to 100 kHz. A nonmagnetic downhole probe unit connected between a drill motor or drill bit and the drill string contains data gathering and transmission components including accelerometers which measure the earth's gravity vector and fluxgate magnetometers which read the earth's magnetic field and serve as power line proximity sensors. The drill pipe acts as an electrical lossy, single conductor with the earth forming the electrical return path. Sensory data gathered by the downhole probe is encoded in digital format and impressed upon the drill string using frequency shift keying of the electromagnetic energy waves and is picked off at the surface by a signal receiver-demodulator and message processor unit. The surface unit instructs the downhole probe to transmit multiple frequencies and selects one or more frequencies with the most favorable signal-to-noise ratio(s) in response to local conditions to maximize the transmission distance at a selective frequency band range and given transmitter power level and baud rate. The received signal is filtered, demodulated, processed and displayed at the surface and gravity and magnetic field vectors are combined with the created hole length to calculate x, y, and z hole coordinates and derive hole position vectors.

DESCRIPTION OF THE PREFERRED EMBODIMENT

Most prior art electromagnetic systems operating under crystal controlled frequency generators operate with one (pulse-width modulation) or two (frequency shift keying (FSK)) fixed signals of low frequency, typically less than 25 hertz. Low frequencies are used to prevent reduction of the signal or "attenuation". The capture low frequency band requirement results in diminished data transmission rate and an inherent nonadaptive nature relative to avoiding interference in the capture frequency band being used.

In contrast, the present electromagnetic data transmission system utilizes microprocessor controlled frequency synthesis selectively activated at start-up or at any time during operation whereby the system transmits multiple frequencies and subsequently selects one or more frequencies with the most favorable signal-to-noise ratio(s) in response to local conditions to maximize the transmission distance and a desired frequency band range at a given transmitter power level and baud rate.

A brief description of the overall system will be undertaken first then followed by a detailed description of the apparatus and circuitry used to carry out the invention.

Figure 1:
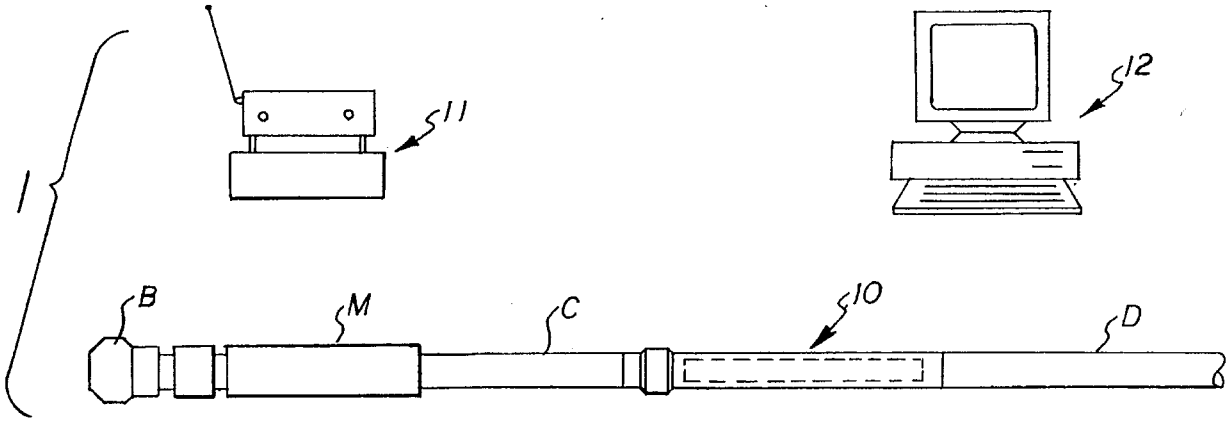
FIG. 1 is a schematic illustration of the major components of the electromagnetic data transmission system in accordance with an earlier prototype and with the present invention.

As represented schematically in FIG. 1, the present electromagnetic data transmission system comprises three modules. A downhole probe unit 10 connected directly behind a drill motor M having a drill bit B at the forward end. If the drill motor is magnetic, a nonmagnetic drill collar C may be installed between the motor M and probe 10. If magnetometers are not used in the system, drill collar C need not be magnetic. The drill string D is connected to the rear end of the probe 10. A signal receiver-demodulator 11 and a message processor and display unit, such as a personal computer (PC) 12 are located at the surface. The function and relationship of one module to another is described hereinafter.

Figure 2:
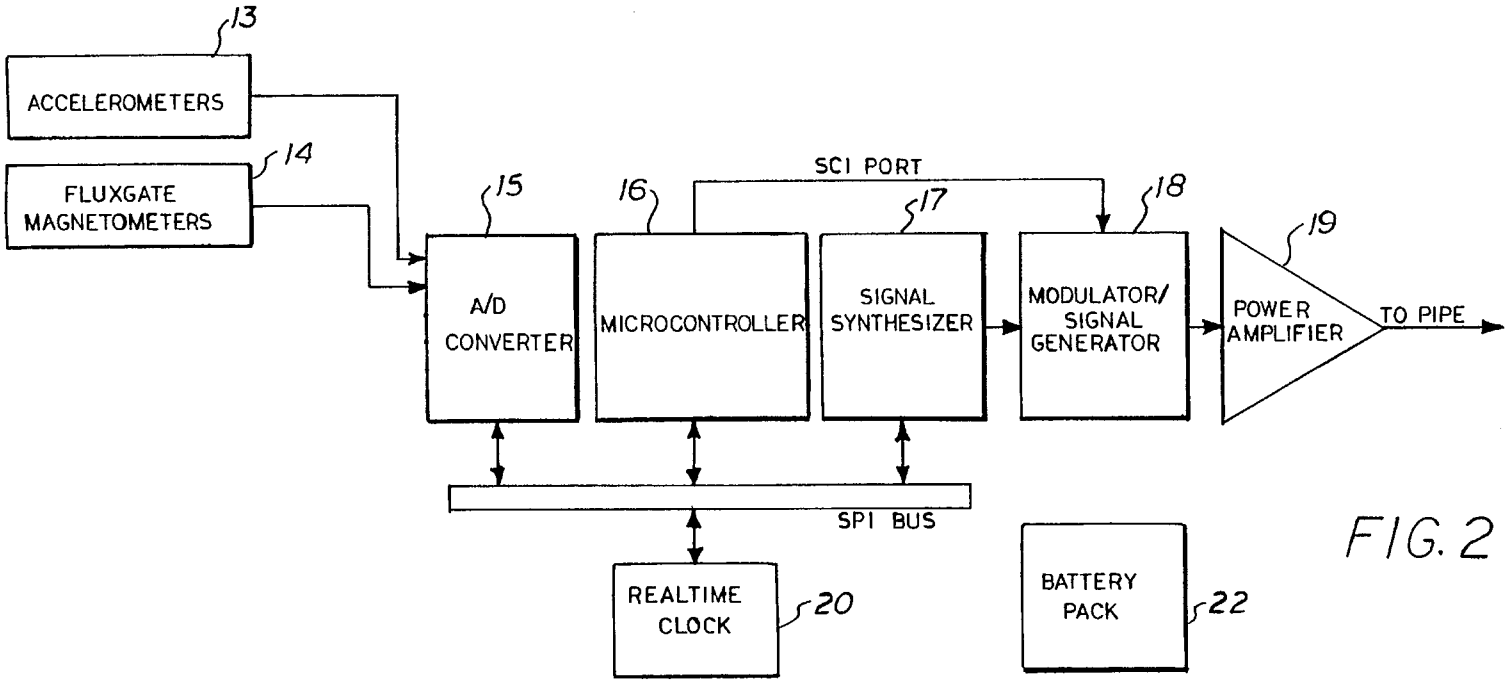
FIG. 2 is a block diagram of data gathering and transmission components of a system shown in FIG. 1 which are carried in the downhole boring unit.
Figure 2A:
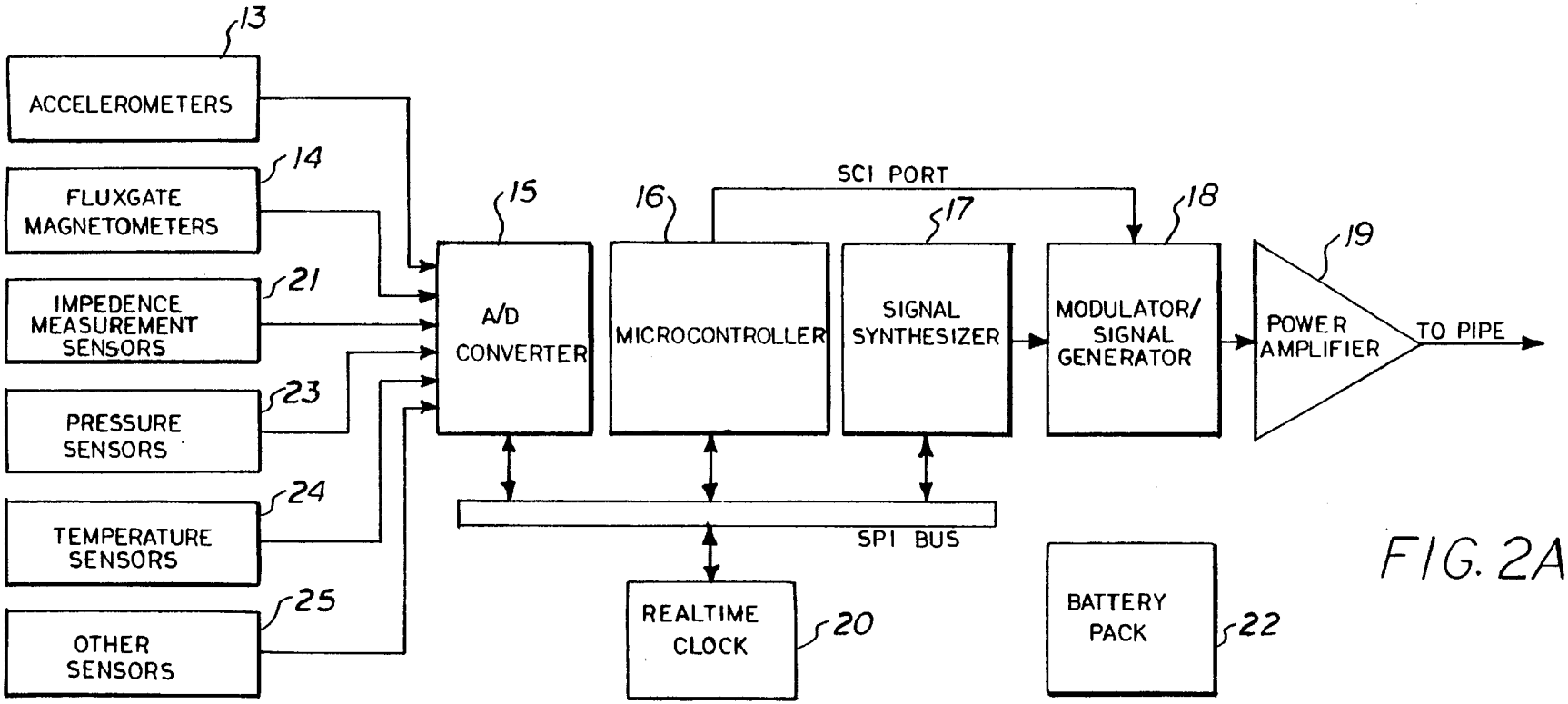
FIG. 2A is a block diagram of data gathering and transmission components of a system which are carded in the downhole probe unit.

The data gathering and transmission components of the system housed within the non-magnetic portion of the downhole probe unit 10 are illustrated in block diagram in FIG. 2. The components within the downhole probe unit include; an accelerometer assembly 13 and a fluxgate magnetometer assembly 14 for sensing gravity acceleration and magnetic-field strength, an analog/digital converter 15, a microcontroller 16, a signal synthesizer 17, a modulator/signal generator 18, a power amplifier 19, a real-time clock 20, earth impedance measuring circuit 21 and a re-chargeable nickel-cadmium battery pack 22 for supplying operating power. The system can be hard wired, and the battery pack eliminated, where suitable power connections are available. Also, other types of battery packs than nickel-cadmium may be used, both rechargeable and non-rechargeable. The fluxgate magnetometer assembly also serves as a power line proximity sensor and can measure magnetic interference generally. The system can be expanded to include additional sensors such as pressure sensors 23, temperature sensors 24, and other appropriate sensors 25 depending upon the particular application.

The electronic package in the downhole probe unit 10 samples the acceleration, magnetic and impedance measuring sensors, encodes the sampled data and transmits data to the surface using an electromagnetic (EM) technique (described hereinafter). Mission time is dependent on the desired update rate of the surface message processor and display unit (PC) 12 which can be selectively set for as often as once per second to as long as one wants to wait.

Figure 3:
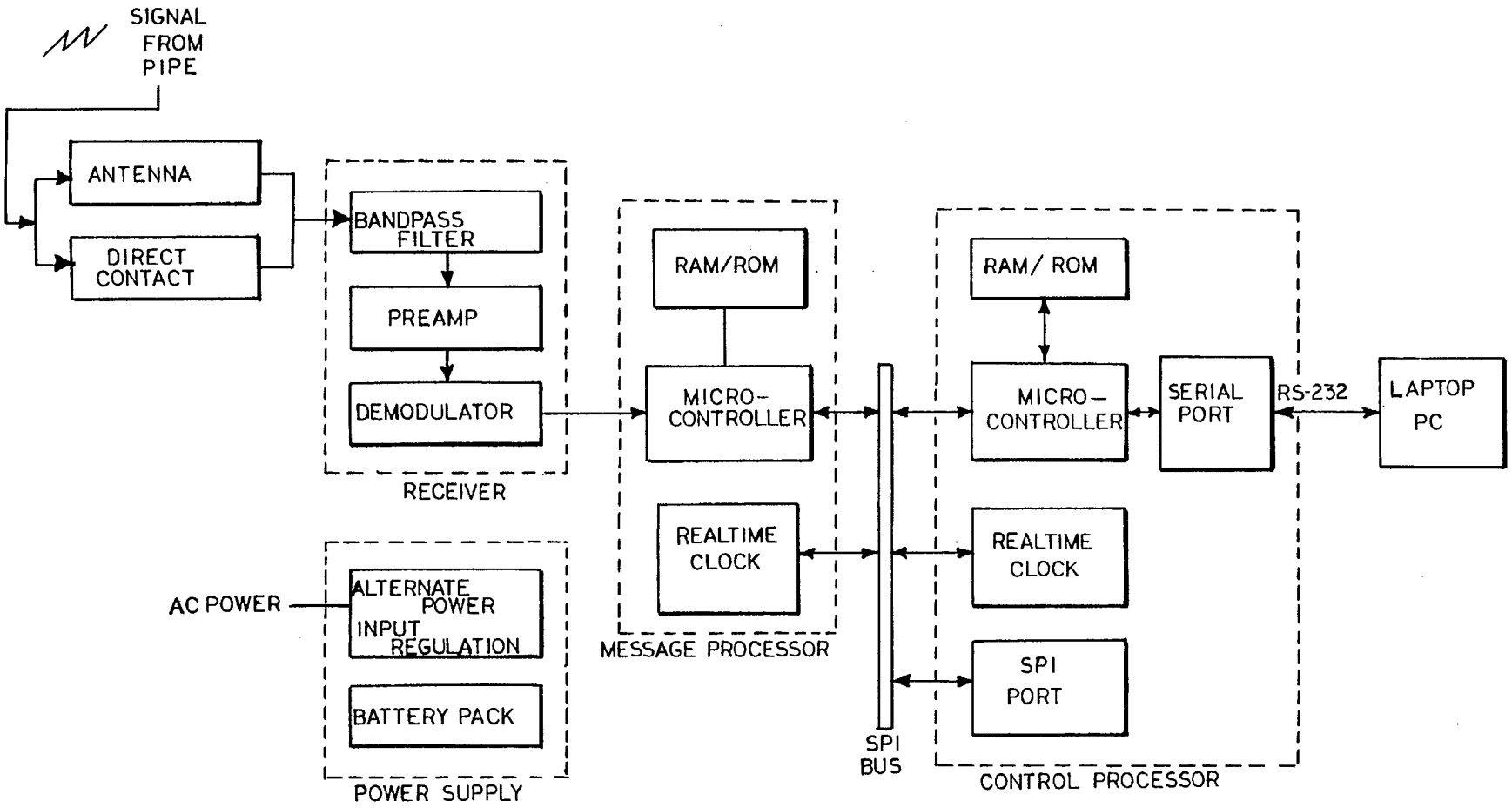
FIG. 3 is a block diagram of the electronic equipment located at the surface for receiving, decoding, and processing the data transmitted from the downhole probe unit.

Referring now to FIGS. 2 and 3, the electronic equipment at the surface is illustrated in block diagram. The uphole electronics is powered by either 12 volt DC or 60 cycle 120 volt AC by using an appropriate adapter plug. The data received by the downhole microcontroller 16 is encoded in a digital format and impressed upon the drill string. The electromagnetic wave transmitted on the drill pipe is picked off at the surface for processing and display using one of two types of pickups. The first type of pickup is a simple antenna which is laid on the surface parallel to the drill pipe. It can be used for shorter distances and air-drilled holes. For longer holes, direct-coupled recovery of the signal is preferred. In this case, a special clamp which directly contacts the drill string or the drill rig is used for signal pickup. The signal is received by the receiver circuitry where it is filtered, demodulated and passed to the message processor circuitry. Here, error detection and correction is employed to ensure that only error-free data is displayed to the operator. The data is subsequently fed to a laptop PC where it is further processed and displayed.

In the preferred embodiment, there are three mutually orthogonal accelerometers 13 and three mutually orthogonal fluxgate magnetometers 14. The accelerometers 13 measure the earth's gravity vector while the fluxgate magnetometers 14 read the earth's magnetic field as well as any other DC and AC fields generated by energized cables or magnetic objects. The onboard microprocessor controls the acquisition and transmission of the earth's gravity and magnetic field vectors which are subsequently used to derive hole position vectors. As these vectors are fixed in both direction and magnitude, the vector components can be mathematically combined to provide compass heading (azimuth angle), inclination (angle made with respect to horizontal) and tool face which represents the angle made by revolving about the borehole axis. These angles are defined by equations shown below:

$$\text{INCLINATION} = \text{TAN}^{-1}\frac{\sqrt{G_x^2+G_y^2}}{G_z}$$

$$\text{AZIMUTH} = \text{TAN}^{-1}\frac{\sqrt{G_x^2+G_y^2+G_Z^2}\quad(H_xG_y-H_yG_x)}{H_z(G_x^2+G_y^2)+H_xG_xG_z+H_yG_yG_z}$$

$$\text{TOOL FACE} = \text{TAN}^{-1}\frac{G_x}{G_y}\ \text{(Gravity)}$$

$$= \text{TAN}^{-1}\frac{H_x}{H_y}\ \text{(Magnetic)}$$

This angular information is combined with the length of hole created to calculate the x, y, and z hole coordinates at multiple stations along the path. The more closely spaced the stations, the greater the accuracy of the survey. Specially designed software run by the message processor and display unit, or personal computer computes both magnetic and gravity tool face data and displays the one selected by the user. The software also has a self-check feature to assure proper system operation. Parameters falling outside a range of acceptability are flagged and a message sent to the uphole unit for display.

The fluxgate magnetometers 14 near the boring head detect the presence of alternating current (AC) fields produced by buried power and telecommunications lines. The system sounds an alarm to the operator indicating the approach of a line. By using two sets of magnetometer readings, it is possible to compute the separation between the boring head and the approaching line.

Figures 4A, 4B, 4C:
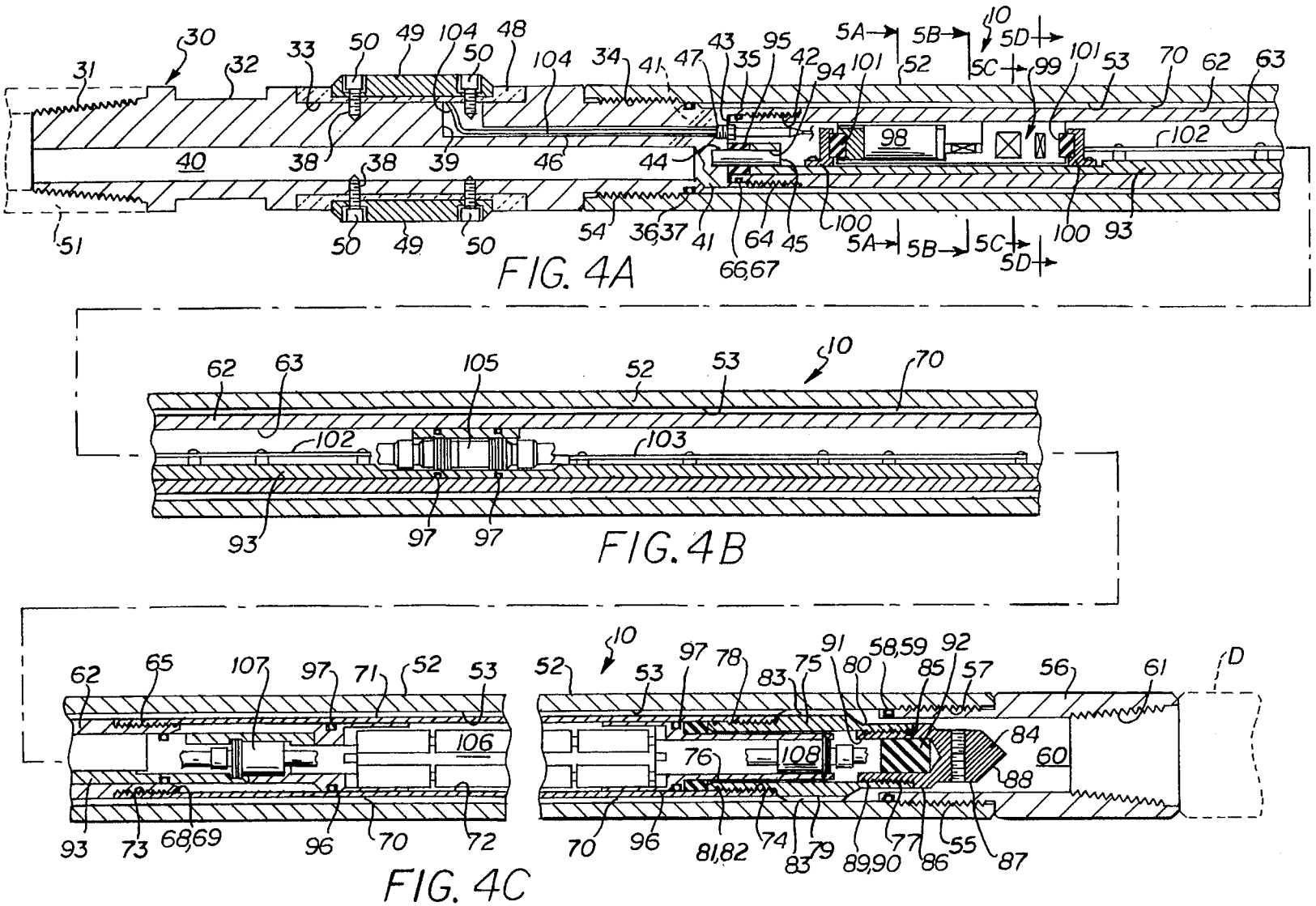
FIGS. 4A, 4B, and 4C are longitudinal cross sections of the downhole probe unit of the present invention.
Figure 5A:
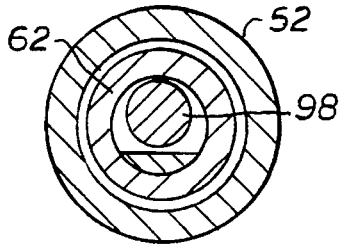
FIG. 5A, 5B, 5C, and 5D are transverse cross sections taken through the mandrel showing the orthogonal magnetometer and accelerometer arrangement.
Figure 5B:
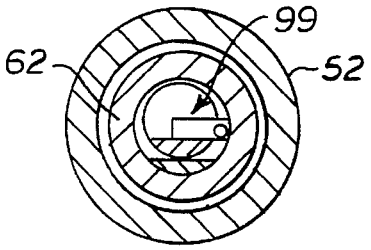
Figure 5C:
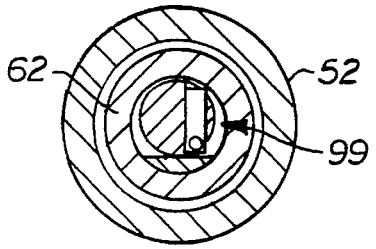
Figure 5D:
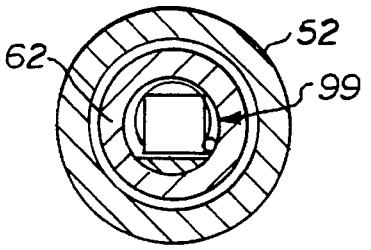

Having generally described the overall operating system, a detailed description of the probe apparatus 10 will be undertaken with reference to FIGS. 4A, 4B, and 4C.

The downhole probe unit 10 has a generally cylindrical forward sub 30 formed of nonmagnetic material. The exterior of the forward sub 30 has external threads 31 at its forward end, wrench flats 32 spaced rearwardly of the threaded portion, a reduced diameter portion 33 spaced rearwardly of the wrench flats 32, a second reduced diameter externally threaded portion 34, and a third reduced diameter portion 35 at its rearward end. An O-ring groove 36 is formed on the exterior of the sub 30 between the threads 34 and the reduced diameter portion 35 and receives an O-ring 37. The reduced diameter portion 33 is provided with drilled and tapped holes 38. A slot 39 extends radially inward from the reduced diameter portion 33.

The interior of the sub 30 has a longitudinal bore 40 spaced from the central longitudinal axis which extends inwardly a distance from the front end. Ports 41 extend angularly outward from the longitudinal bore 40 to the exterior of the sub 30 rearwardly of the O-ring groove 36. The third reduced diameter portion 35 of the sub 30 has internal threads 42 extending inwardly a distance from the rear end and terminating at an interior wall 43. A small bore 44 coaxial with the central longitudinal axis of the sub 30 extends inwardly a short distance from the wall 43. A rod 45 is secured in the bore 44 and extends a distance rearwardly. A longitudinal ground wire passageway 46 spaced from the central longitudinal axis of the sub 30 extends inwardly from the interior wall 43 and joins the slot 39. The rearward end of the wire passageway 46 is threaded to receive a ground wire connector 47.

A sleeve 48 of electrically nonconductive insulating material, such polyurethane or other suitable polymer surrounds the reduced diameter portion 33. A segmented tubular ground ting 49 is secured by cap screws 50 to encircle the reduced diameter portion 33 with the insulating sleeve 48 disposed between the exterior of the reduced diameter portion and interior of the ground ring.

A conventional drill motor and/or drill bit 51, represented in dashed line, is threadedly connected at the front end of the forward sub 30. If the drill bit or motor 51 is made of magnetic material, a section of nonmagnetic drill collar is installed between the motor/bit and the front of the forward sub 30 to provide sufficient isolation of the fluxgate magnetometer devices carried in the downhole probe unit rearwardly of the bit or motor.

An elongate tubular outer housing 52 formed of nonmagnetic material and having a central longitudinal bore 53 with internal threads 54 and 55 at each end is threadedly connected at one end to the external threads 34 near the rear portion of the forward sub 30. The exterior of the outer housing 52 also has an insulating coating, such as anodizing.

Thus, the ground ring 49 is electrically insulated and the electrically insulating coating (e.g., anodizing) on the exterior of the outer housing 52 increases the effective gap width (and thereby drive input impedance) between the two elements. The ground ring 49, isolated from the rest of the drill string, contacts the earth and, since the outer housing is anodized, or coated with other types of electrically insulated materials, the drill string (other side of the circuit) does not come into electrical contact with the earth for several feet. This separation allows the signal to travel farther along the drill pipe.

As seen in FIG. 4B, a cylindrical rear sub 56 formed of non-magnetic material having external threads 57 at its forward end is threadedly received in the threaded rearward end 55 of the outer housing 52. An O-ring groove 58 is formed on the exterior of the rear sub 56 forward of the threads 57 and receives an O-ring 59 which forms a seal on the central bore 53 of the outer housing 52. The rear sub 56 has a central bore 60 with internal threads 61 at its rearward end. The lowermost section of drill string tubing D is threadedly received in the threads 61 of the rear sub 56.

An elongate tubular mandrel housing 62 formed of non-magnetic material and having a central longitudinal bore 63 with external threads 64 and 65 at each end is threadedly connected at one end to the threads 42 on the interior of the third reduced diameter portion 35 of the forward sub 30. An O-ring groove 66 is formed on the exterior of the mandrel housing 62 forward of the threads 64 and receives an O-ring 67 which forms a seal on the interior of the forward sub 30. An O-ring groove 68 is formed on the exterior of the mandrel housing 62 rearward of the threads 65 and receives an O-ring 69 which forms a seal on the interior of a battery housing (described below). The mandrel housing 62 is received concentrically within the outer housing 52 and its exterior diameter is smaller than the outer housing longitudinal bore 63 to define an annulus 70 therebetween. The annulus 70 is in fluid communication with the longitudinal bore 40 of the forward sub 30 through the angularly extending ports 41.

An elongate tubular battery housing 71 formed of non-magnetic material and having a central longitudinal bore 72 with internal threads 73 and 74 at each end is threadedly connected at its forward end to the threads 65 on the rearward end of the mandrel housing 62 (FIG. 4B). The O-ring 69 on the mandrel housing 62 forms a seal on the interior bore 72 of the battery housing 71. The battery housing 71 is received concentrically within the outer housing 52 and its exterior diameter is approximately the same as that of the mandrel housing 62 to define an extension of the annulus 70.

A generally cylindrical end cap 75 formed of nonmagnetic material is installed at the rearward end of the battery housing 71. The interior of the end cap 75 has a central longitudinal bore 76 with threads 77 at the rearward end. The exterior of the end cap 75 has a reduced diameter forward end with external threads 78, an enlarged diameter portion 79 rearwardly of the threads 78, and a second reduced diameter portion 80 at its rearward end. An O-ring groove 81 is formed on the exterior of the end cap 75 forward of the threads 78 and receives an O-ring 82 which forms a seal on the interior bore 72 of the battery housing 71. The enlarged diameter 79 of the end cap is slidably received in the interior bore 53 of the outer housing 52 and is provided with longitudinal slots 83 to form a fluid passageway therebetween.

A generally cylindrical plug 84 formed of nonmagnetic material is installed at the rearward end of the end cap 75. The exterior of the plug 84 has a reduced diameter forward end with external threads 85, an enlarged diameter portion 86 rearwardly of the threads 85, and a second reduced diameter portion 87 terminating in a conical portion 88 at its rearward end. An O-ring groove 89 is formed on the exterior of the plug 84 forward of the threads 85 and receives an O-ring 90 which forms a seal on the interior of the end cap 75. A central bore 91 extends inwardly a distance from the forward end of the plug 84 and receives a cylindrical cushion 92 of shock absorbing material, such fine-celled, low compression set, high density polyurethane foam.

The second reduced diameter portion 80 of the end cap 75 and enlarged diameter 86 of the plug 84 are approximately the same diameter and smaller in diameter than the bore 60 of the rear sub 56. The longitudinal slots 83 through the enlarged diameter 79 of the end cap 75, the second reduced diameter portion 80 of the end cap 75 and the enlarged diameter 86 of the plug 84 form an extension of the annulus 70.

Thus, a fluid flow passageway is established through the downhole probe unit 10 from the interior of the drill string D to the interior of the forward sub 30 connected to the drill motor and/or drill bit. The fluid flow passageway extends from the interior of the rear sub 56 and between the interior bore 53 of the outer housing 52 and the exterior of the end cap 75 through the slots 83, the exterior of the battery housing 71, the exterior of the mandrel housing 62, through the angularly extending ports 41, and into the longitudinal bore 40 of the forward sub 30. The ports 41, slots 83, and the cross section of the annulus 70 are sized to support typical drilling fluid flow rates and the normal range of solid particles.

An elongate mandrel 93 formed of nonmagnetic material is carried inside the mandrel housing 62 and serves as the mounting unit for the sensors and electronic circuitry. The forward end of the mandrel 93 has two holes 94 which are slidably received on the rods 45 (FIG. 4A). A cylindrical cushion 95 of shock absorbing material, such fine-celled, low compression set, high density polyurethane foam, is carried on the rod 45 and has one end engaged on the wall 43 and its other end engaged on the front end of the mandrel 93. The mandrel 93 is slidably received inside the mandrel housing 62 and has an enlarged diameter rear portion 96 which is slidably received inside the battery housing 71. The exterior of the mandrel 93 is provided with O-rings 97 to support the mandrel along its length within the mandrel housing 62 and battery housing 71.

A magnetometer assembly 98 and an accelerometer assembly 99 are mounted between retainer members 100 on the mandrel 93 near its forward end. Cushions 101 of shock absorbing material, such as of fine-celled, low compression set, high density polyurethane foam, are positioned between the ends of the assemblies 98, 99 and the retainers 100. In the preferred embodiment, there are three mutually orthogonal fluxgate magnetometers 98 and three mutually orthogonal accelerometers 99. The sensors may also include additional sensors such as temperature sensors and pressure sensors.

A sensor circuit board 102 is mounted on the mandrel 93 rearwardly of the magnetometer and accelerometer assemblies 98 and 99 and contains the sensor circuitry (described below). A transmitter circuit board 103 is mounted on the mandrel 93 rearwardly of the sensor circuit board 102 and contains the transmitter circuitry ( described below).

A ground wire 104 (FIG. 4A) connected to the ground ring 49 extends through the slot 39 in the forward sub 30 and through the ground wire passageway 46 and is joined by a connector 47 and wire leads (not shown) to the circuit boards 102 and 103. Wire leads (not shown) connect the sensor circuitry and transmitter circuitry through a connector 105 (FIG. 4B). A rechargeable nickel-cadmium battery pack 106 contained within the battery housing 71 is connected by connector 107 to the sensor and transmitter circuitry for supplying operating power. Another connector 108 is provided rearwardly of the battery pack 106 for connecting either a run plug to initiate operation of the downhole probe or a programming line to allow its operating variables to be changed under user control.

The sensors (magnetometers 98 and accelerometers 99) are cushioned by two shock absorbing systems. They are mounted on the mandrel 93 which is suspended on two ends by the cushions of polyurethane foam 101. These mounting points provide shock and vibration isolation in all three axes. The foam cushions are sized so the sensors can withstand shock loads significantly greater than they could without isolation.

The second shock absorption system protects the printed electronic circuit boards 102 and 103 and battery pack 106 as well as the environmental sensors 98 and 99. The battery pack 106 and circuit board mandrel 93 are radially suspended by the O-rings 97. The O-rings 97 provide radial cushioning while allowing torsional movement. In the axial direction, the battery pack/mandrel assembly is bounded by polyurethane foam cushions 92 and 95.

In a preferred embodiment, the downhole probe unit 10 is approximately ten feet in length and its exterior diameter is sufficiently small to run inside 2.75-inch diameter or larger pipe while maintaining full flow capability to wet bore, and can operate with air or mud-powered downhole assemblies. The electronic circuit boards and sensors are mounted to withstand the rigors of field use and the resilient cushions protect against damage from shock and vibration. The probe unit is suitable for use at pressures to 5000 psi and temperatures to 50° C., however, higher pressure and temperature units may also be provided depending upon the particular application. In another embodiment, the probe has a 1.375" O.D. pressure housing that can fit in 2.0" O.D. collars.

Figure 6:
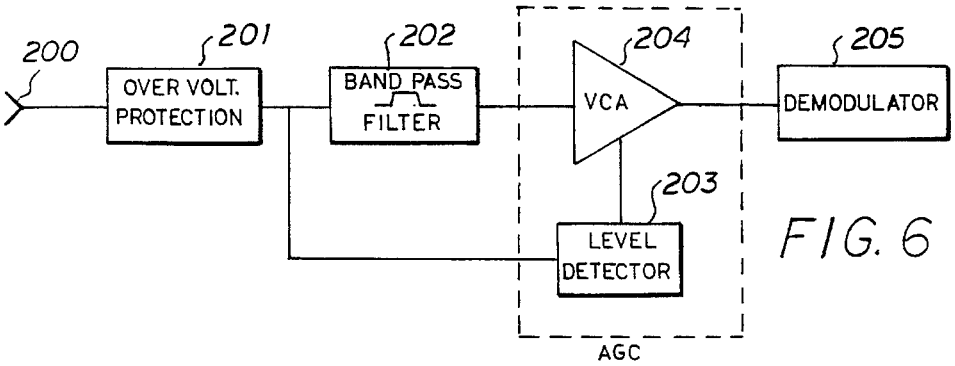
FIG. 6 is a block diagram of the automatic gain control (AGC) portion of the electrical circuitry of the surface electronics.
Figure 7:
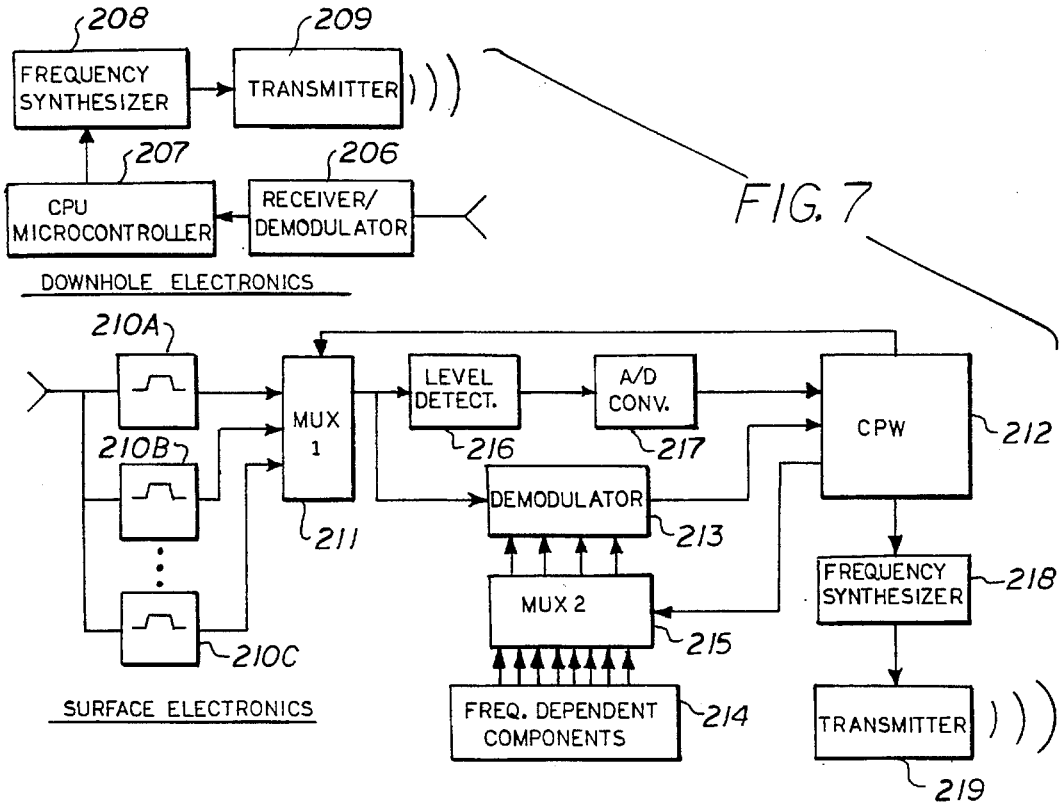
FIG. 7 is a block diagram of the surface and downhole electronic circuitry which provides the ability to optimize the transmission frequency for two-way communication between the surface and downhole units.
Figure 8:
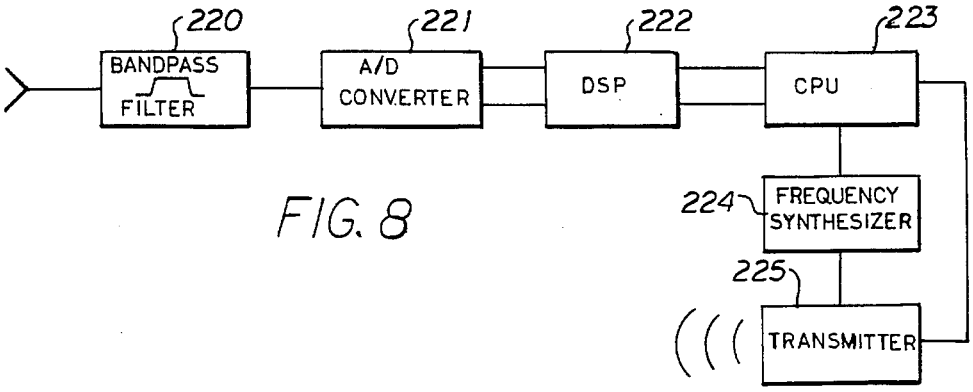
FIG. 8 is a block diagram of an alternate digital form of surface circuitry.

Having described the downhole probe apparatus, a description of the sensor/receiving and transmitting circuitry follows with reference to FIGS. 6, 7, and 8.

FIG. 6 illustrates in block diagram, the automatic gain control (AGC) portion of the electrical circuitry of the surface electronics. The electromagnetic wave transmitted on the drill pipe is picked off at the surface for processing and display using one of two types of pickups. The first type of pickup is a simple antenna 200 which is laid on the surface parallel to the drill pipe. It can be used for shorter distances and air-drilled holes. For longer holes, direct-coupled recovery of the signal is preferred. In this case, a special clamp (not shown) which directly contacts the drill string is used for signal pickup. The AGC circuit decodes signals from as low as a few millivolts to as high as the maximum transmission voltage of the downhole probe. An overvoltage protection portion 201 of the circuit protects the rest of the circuit from any transmission which may exceed the circuit's operating voltage. The incoming signal passes through a bandpass filter 202 which passes only the frequencies which contain data to be decoded. The AGC portion has two sections: a level detector 203 and a voltage-controlled amplifier (VCA) 204. The level detector 203 determines the amplitude of the received signal (before the bandpass filter 202) and outputs a proportional control voltage. The VCA 204 amplifies (or attenuates) the filtered signal in inverse proportion to the control voltage from the level detector 203 and sends it to a demodulator 205. Thus, the signal level fed to the demodulator 205 is fairly constant, regardless of the level of the received signal.

The automatic gain control circuit allows the system to handle the wide dynamic range of received signal strength resulting from significant variations in earth conductivity, presence or absence of drilling mud in the hole and the length of drill pipe. The automatic gain control circuit prevents overload of the receiver-demodulator and minimizes the potential of it becoming saturated by signal or noise.

FIG. 7 illustrates in block diagram, the surface and downhole electronic circuitry which provides the ability to optimize the transmission frequency for two-way communication between the surface and downhole units. The downhole electronic circuitry includes: a receiver/demodulator 206, a microcontroller 207, a frequency synthesizer 208 and a transmitter 209. The downhole receiver/demodulator 206 receives a frequency shift keying (FSK) signal (other signals may be used) from the surface electronics which is filtered and demodulated into digital information and processed by the CPU microcontroller 207. Other types of encoding, e.g., PSK, may be used where desirable. The frequency synthesizer 208 generates two output frequencies simultaneously by dividing down the CPU's real-time clock signal. The CPU 207 sets the two frequencies and controls which frequency (if any) is sent to the transmitter 209 so that the digital information can be encoded and transmitted. The transmitter 209 boosts the power of the transmitted signal so that it can reach the surface electronics via the drill pipe which acts as a lossy conductor. Output is stopped between messages to conserve power.

The surface electronic circuitry includes: several bandpass filters 210A, 210B and 210C, a first multiplexer 211, a CPU 212, a demodulator 213 having frequency-dependent components 214, a second multiplexer 215, an RMS-to-DC level detector 216, an analog/digital (A/D) converter 217, a frequency synthesizer 218, and a transmitter 219. The bandpass filters 210A, 210B and 210C are tuned to different frequencies, which can be selected with the first multiplexer 211 controlled by the CPU 212. The filtered signal is fed to the demodulator 213 having frequency-dependent components 214 which are selected with the second multiplexer 215 controlled by the CPU 212. The filtered signal is also fed to the RMS-to-DC level detector 216. The DC level is transformed to digital information by the A/D converter 217 and fed to the CPU 212. The surface frequency synthesizer 218 and transmitter 219, are similar to the downhole counterparts, except that they transmit at fixed, low baud rate frequencies to maximize transmission distance.

The surface and downhole electronic circuits operate in two modes: a search mode and an operate mode. In the search mode, the downhole probe unit 10 transmits several frequencies and the surface circuitry selects the optimum frequency, baud rate, and update rate. In the operate mode, the downhole probe unit 10 transmits information from its sensors to the surface circuitry using the optimized parameters for the purpose of steering the boring bit.

In the search mode, the surface CPU selects the first bandpass filter 210A with the first multiplexer 211 and, at the same time, the frequency-dependent components 214 for the demodulator 213 are selected with the second multiplexer 215. At this point in time, the downhole probe unit 10 is not transmitting, and the surface circuitry measures the level of the background noise through the bandpass filter 210A. The surface circuitry then transmits an instruction signal downhole instructing the downhole probe unit 10 to transmit at a frequency within the passband of the filter 210A. The received signal level is again measured by the surface circuitry. The surface CPU now has information on both the background noise and the transmit signal levels, from which the signal-to-noise ratio can be computed. The surface CPU then selects the next bandpass filter 210B and transmission frequency. This process is repeated until the signal-to-noise ratios have been measured through each available bandpass filter.

The surface CPU (or a human operator) then determines; (a) which frequency to use, and (b) what update rate to use, based on several criteria. Signal-to-noise ratio is important to insure error-free communication, thus frequency ranges with high signal-to-noise ratios are preferred. Because different frequencies attenuate at different rates through the earth, the planned length of the hole will affect the choice of the frequency. The transmission frequencies will determine the allowable communication baud rate. The baud rate affects the duration of each transmission and thus the power consumption. The planned length of the hole to be drilled also affects the power consumption. For a short hole, the downhole probe unit can send data often, but for a long hole, the update rate must be decreased in order to conserve power.

In the operate mode, after the surface CPU (or human operator) has determined the optimum transmission frequency, baud rate, update rate, and bandpass filter, the surface CPU will transmit the corresponding codes to the downhole probe unit to cause it to select these operating parameters. The surface and downhole probe units then switch to the operate mode wherein the downhole probe unit transmits the data from the sensors. The surface circuitry receives and filters the data signal, demodulates it into digital data, and sends the digital data to the surface CPU for processing and display.

Alternatively, as illustrated in block diagram in FIG. 8, the surface electronics may be provided in a digital form which would require less hardware, and be more flexible than the analog system described above. In this embodiment, the surface electronic circuitry includes: a broadband bandpass filter 220, an analog/digital (A/D) converter 221, an integrated digital signal processor (DSP) chip 222, a CPU 223, a frequency synthesizer 224, and a transmitter 225. The signal received from the downhole probe unit is fed through the broadband bandpass filter 220 to eliminate signals outside the transmission frequency range. The filtered signal is converted to digital format by analog/digital (A/D/) converter 221 and fed to the digital signal processor (DSP) chip 222 for processing.

In the search mode, the digital signal processor (DSP) chip 222 samples the broadband background noise and performs "Fast Fourier Transform" (FFT) power spectrum calculations to determine the signal-to-noise ratio for each frequency and find the quite region(s). The surface circuitry transmits an instruction signal downhole instructing the downhole probe unit to generate a family of frequencies within the quiet regions while the digital signal processor (DSP) chip 222 samples the signals and performs another round of "Fast Fourier Transform" (FFT) power spectrum calculations to determine individual signal strengths and selects the optimum frequencies. The surface CPU then instructs the downhole probe unit to transmit data at those frequencies.

In the operate mode, the digital signal processor (DSP) chip 222 through the surface CPU 223 and frequency synthesizer 224 selects two desired frequencies and then synthesizes two highly selective digital bandpass filters, one to match each transmit frequency whereby the frequency shift keying (FSK) signal is decoded and sent to the surface CPU 223 for processing and display. It should be understood that repeaters can be provided to boost signal strength as the signal is transmitted and retransmitted to the surface. It should also be understood that other coding systems, such as pulse shift keying (PSK) can be used in this system.

At the surface, the processed data is displayed on a screen at the PC in various formats. For example, the primary run screens would indicate graphically a sequence of bore lengths with a circle and pointer at one side of the screen. The pointer would display the tool's roll angle or steering direction. The same data would be displayed in numerical form in a box at one comer of the screen. The pitch angle (inclination angle) of the drill head would be displayed in the center of the circle. The computed x, y, and z coordinates of the hole for the last survey station computed and the tool's compass heading would be displayed on the other side of the screen. The coordinates may be expressed in an east-west, north-south and depth format or other format selected to suit user preference.

A series of function keys would be displayed at the bottom of the screen which control; computing another survey, saving the data to disk file, graphics plotting of the hole trajectory, and custom setup functions. The graphics would support both plan and elevation plots of the hole path versus distance and feature zoom in/zoom out. Similarly, the routine for survey computation would allow the user to select a default length of drill pipe.

Figure 9:
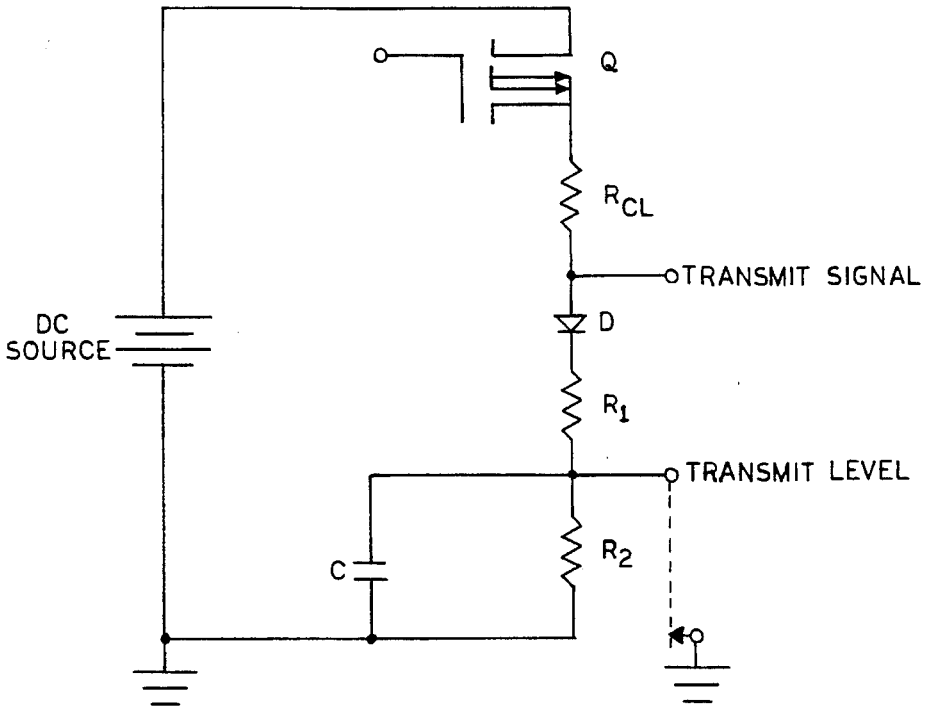
FIG. 9 is a block diagram of the earth electrical impedance measurement circuit.

The impedance measurement circuitry is provided in FIG. 9. Transistor Q is controlled by the frequency synthesizer to turn the DC source on and off. A current limiting resistor ($R_{CL}$) is used in series with the transmit signal. The voltage of the DC source is compared with the voltage of the transmit signal after the limiting resistor ($R_{CL}$). The difference indicates the current flowing across the dipole D gap, from which the impedance of the gap can be calculated. A voltage divider ($R_1$, $R_2$) is used to reduce the signal level to that which can be read by the analog to digital converter. The transmit signal charges the capacitor C on the bottom leg of the divider so a constant voltage can be measured, even though the transmit signal cycles on and off. The diode D is used to look at only the positive polarity of the transmit signal. The impedance is calculated by dividing the voltage across the resistor $R_{CL}$ by the current through the resistor.

Figure 10:
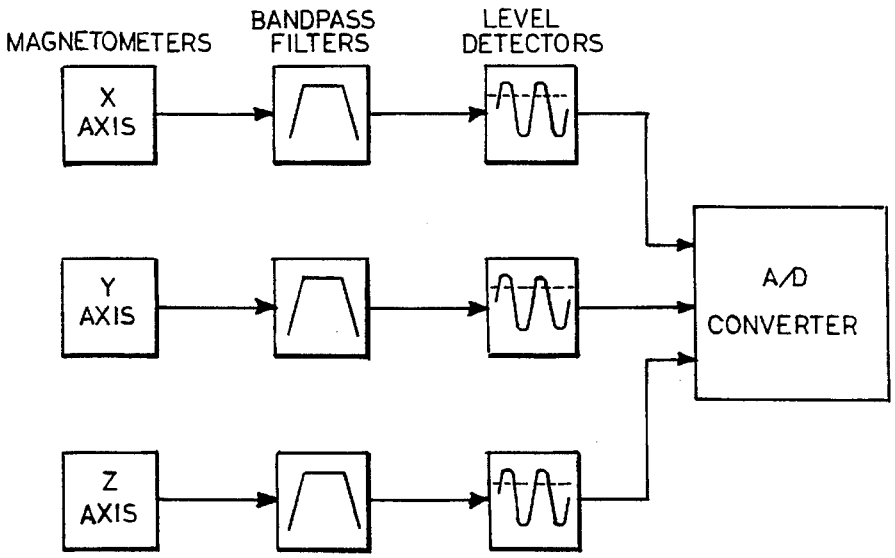
FIG. 10 is a block diagram of the AC field detection circuit for identifying the presence of energized cables in the near vicinity of the boring head.

The proximity detection of energized power cables (both AC and DC) is illustrated in FIG. 10. The signal from each of three axes of the magnetometers is filtered to select the frequency of interest. For AC detection, a 50-Hz or 60-Hz bandpass filter would typically be used, though other frequencies of interest could be selected. For DC detection, the filter would be a low-frequency (e.g., 1 Hz) low-pass filter.

For AC detection, the filtered signal goes through a detector, which converts the AC signal into a DC level which can be measured by the analog to digital converter. A minimum of two measurements of the AC fields are then taken and compared. The physical laws defining AC magnetic field strengths, such as provided below, are then applied to determine the approximate distance between the energized cable and the magnetic field measuring sensors. This distance can then be compared with a minimum allowable distance pre-selected by the operator. When the two distances match, an alarm message is telemetered to the operator warning him of an impending strike. The signal can also be connected to the drilling rig controls to automatically stop further progress. While a fluxgate magnetometer has been mentioned as the preferred embodiment, other types of magnetic field coils can be used.

The magnetic field of transmission lines is calculated using a two-dimensional analysis assuming parallel lines over a flat earth. Using the coordinate system described in FIG. 11, where the axis, Z, is parallel to the line, the magnetic field strength, $H_{j,i}$, at point $(X_i, Y_i)$ at a distance, $r_{i,j}$, from a conductor with a current, $I_i$, has an amplitude
In vectorial notation, $$H_{j,i} = \frac{I_i}{2\pi r_{ij}}$$

$$\vec{H}_{j,i} = \frac{I_i \times r_{j,i}}{2\pi r_{i,j}^2} = \frac{I_i}{2\pi r_{i,j}} \phi_{i,j}$$

The total magnetic field is the sum of all the contributions from line currents:

$$\vec{H}_j \Sigma \frac{I_i}{{}_i 2\pi r_{i,j}} \phi_{i,j}$$

DC field detection process compares the earth's magnetic field value in the area of use with those obtained by the magnetometer. The difference (in the form of a higher than expected DC vector magnitude) is the result of proximity to buried magnetic structures or an energized DC cables. This data is then handled in a fashion analogous to that employed in AC field detection.

OPERATION

The downhole probe unit 10 is mounted directly behind the drill head or motor if that section is made of a nonmagnetic material. If this is not the case, a section of nonmagnetic drill collar is installed in front of the probe 10 to provide sufficient isolation of the onboard fluxgate magnetometer. Prior to installing the probe in the drill string, the onboard electronic system is activated by installing a "run" plug (not shown) into the back of the housing. This plug causes the system to boot up, run a diagnostic self check, and to begin transmitting sensor data.

The surface receiver pickup is mounted at a convenient location on or near the drill frame. The only requirement is that the location is in close proximity to the pipe if using the antenna mode or in direct electrical connection with the drill pipe if direct coupling is required. The receiver pickup should be away from areas that might either result in its damage or hinder the crew's ability to operate the rig.

The message processor and PC are activated and the surface display unit will immediately begin to display data. The bandpass filters of the surface electronics can be switched into (made an active part of) the receiver circuitry. Upon command from the surface electronics, the downhole transmitter sequentially generates multiple frequency sets that match the filters. The surface electronics measure the received signal strength and noise level at each transmitted frequency using the appropriate filter. A transmission frequency set is then chosen based on the following criteria: 1) signal strength; 2) signal-to-noise ratio; 3) baud rate required; 4) transmission update rate; 5) planned transmission distance and 6) power management considerations. After applying the desired criteria to produce a selection, the surface electronics send a signal down to the downhole probe unit instructing it what frequencies to use for data transmission.

Until the first survey, this data will consist of the drill bit compass heading, start depth, tool-face angle and inclination angle. As each joint is drilled, the user can then request computation of the hole x, y, and z coordinates by entering the length of drill pipe in the hole and striking a function key while the drill string is momentarily held stationary (usually while adding a joint of pipe). Once the survey is computed, the coordinates are displayed and drilling can resume.

The proximity detection of energized power cables (both AC and DC) is illustrated in FIG. 10. The signal from each of three axes of the magnetometers is filtered to select the frequency of interest. For AC detection, a 50-Hz or 60-Hz bandpass filter would typically be used, though other frequencies of interest could be selected. For DC detection, the filter would be a low-frequency (e.g., 1 Hz) low-pass filter.

For AC detection, the filtered signal goes through a detector, which converts the AC signal into a DC level which can be measured by the analog to digital converter. A minimum of two measurements of the AC fields are then taken and compared. The physical laws defining AC magnetic field strengths, such as provided below, are then applied to determine the approximate distance between the energized cable and the magnetic field measuring sensors. This distance can then be compared with a minimum allowable distance pre-selected by the operator. When the two distances match, an alarm message is telemetered to the operator warning him of an impending strike. The signal can also be connected to the drilling rig controls to automatically stop further progress. While a fluxgate magnetometer has been mentioned as the preferred embodiment, other types of magnetic field coils can be used.

The fluxgate magnetometers near the boring head detect the presence of alternating current (AC) fields produced by buried power and telecommunications lines. The system sounds an alarm to the operator indicating the approach of a line. By using two sets of magnetometers it is possible to compute the separation between the boring head and the approaching line. The magnetometer output is sent to a bandpass filter in the detection frequency band of interest. The output of the filter is rectified and filtered, thus converting the AC signal to a DC signal level suitable for sampling by the A/D converter. Operator warning commences upon exceeding a preset number of A/D counts.

DC field detection process compares the earth's magnetic field value in the area of use with those obtained by the magnetometer. The difference (in the form of a higher than expected DC vector magnitude) is the result of proximity to buried magnetic structures or an energized DC cables. This data is then handled in a fashion analogous to that employed in AC field detection.

The downhole probe unit 10 may also be configured to run on wireline for use as a wireline steering tool by connecting the plug at the back end of the unit to the surface with a single conductor-insulated wire. The downhole probe unit can also be configured to respond to a homing signal which would allow the operator to bring the bore directly on target using triangulation.

Figure 11:
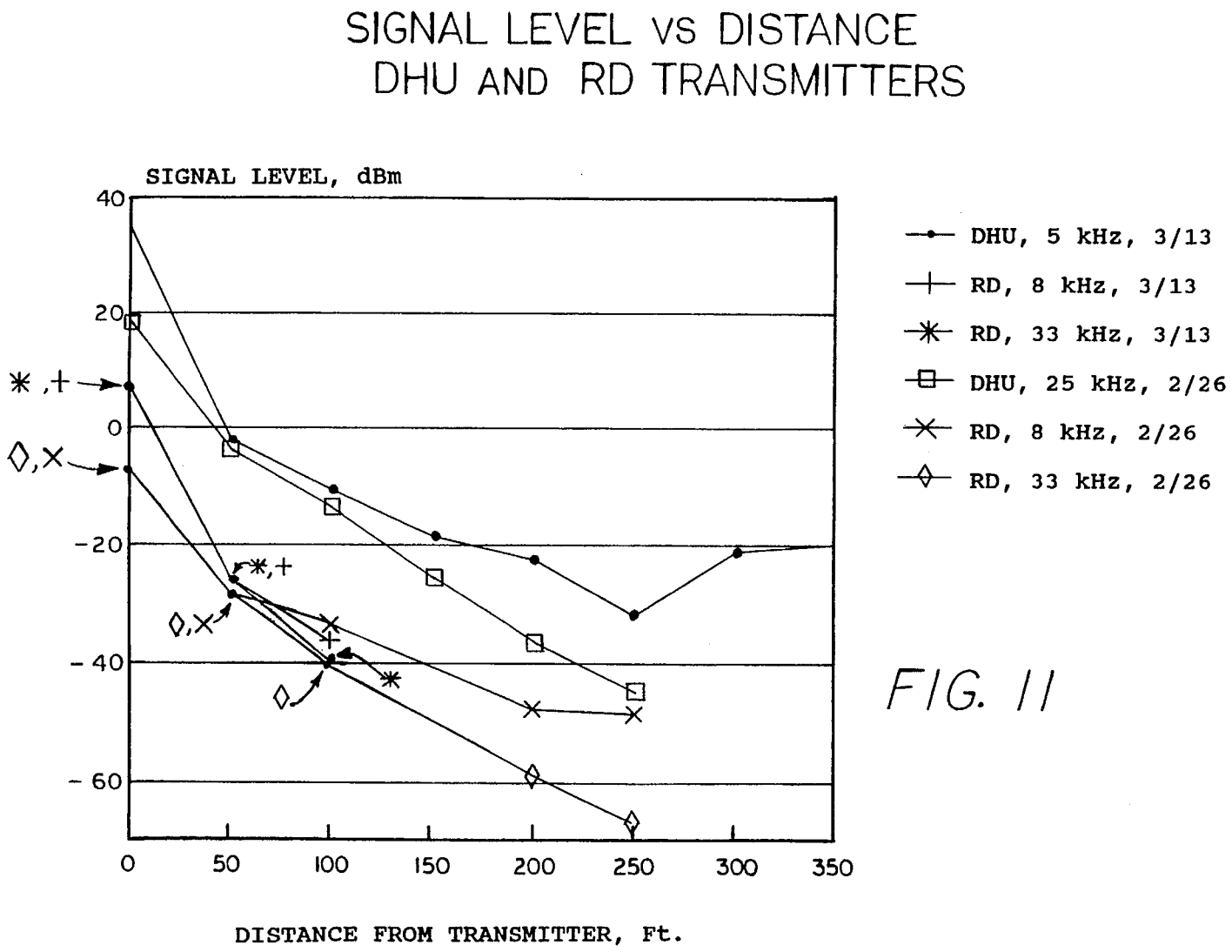
FIG. 11 is a chart showing the relationship of signal level to distance from transmitter for different frequencies.

The chart shown in FIG. 11 illustrates the relationship fo signal level attenuation to distance from the transmitter for different frequencies in the use of this system. The transmission frequencies and baud rates of the system are programmable. The primary criterion for selecting the transmission frequencies is the signal-to-noise ratio (S/N). The higher the S/N, the better the chance of properly decoding the message, Also, the operator will classify the planned bore as "long" or "short". A long bore is in the range of 1000 feet. A short bore is in the range of less than 300 feet. If a bore is long, the lowest frequencies tend to attenuate less with distance. Example frequencies of 5 kHz, 8 kHz, 25 kHz and 33 kHz are indicated in FIG. 11. This figure shows how lower frequencies attenuate less with distance than high frequencies. Looking at the slopes of the curves from distances between 50 and 250 feet, the signal levels at high frequencies decrease more quickly.

Figure 12:
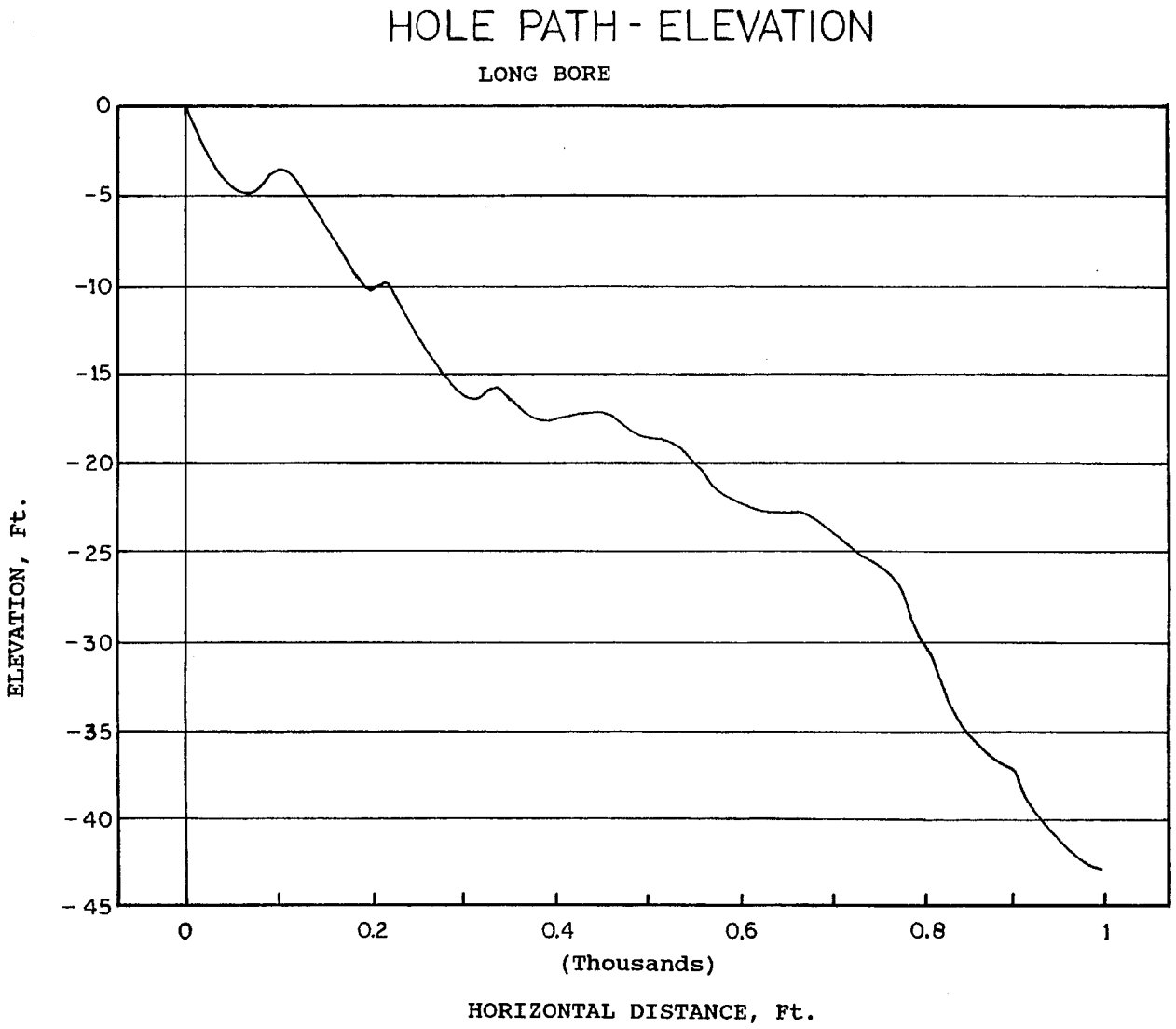
FIG. 12 is a chart showing an elevation view of a 1000 foot bore made to demonstrate reliable communications using the present invention.

The chart in FIG. 12 illustrates an elevation view of a 1000 foot bore made to demonstrate reliable communications using this system. An FSK coding scheme was used with a center frequency of about 2,000 Hz. Reliable data were received for the entire 1,000 feet, proving successful operation of the system at frequencies well above 25 kHz. This system has successfully sent data at a frequency of 33 kHz using FSK across a 1,000 foot bore.

While this invention has been described fully and completely with special emphasis upon a preferred embodiment, it should be understood that within the scope of the appended claims the invention may be practiced otherwise than as specifically described herein.

We claim:

1. A wireless communications system for two way communication along a borehole extending into the earth from the surface, the drill pipe functioning as an electrical lossy, single conductor with the earth forming the electrical return path, the system comprising;

a probe unit supported adjacent to the lower end of said drill pipe including means for collecting data, a microprocessor-controlled frequency synthesizer for producing frequencies in the range from 15 Hz to 100 kHz for transmission of data, transmitter means for encoding data from said data collection means into an electromagnetic signal generated by said frequency synthesizer in the form of simultaneously encoded multiple frequencies impressed simultaneously on said drill pipe, and a receiver-demodulator located at the earth surface receiving and decoding a signal from said encoded multiple frequencies from said transmitter means.

2. A wireless communications system according to claim 1 including;

means responsive to local conditions in said borehole for directing said frequency synthesizer to transmit at the optimal transmission frequencies having the most favorable signal-to-noise ratio.

3. A wireless communications system according to claim 1 in which;

said drill pipe has a motor at the lower end and a drill bit driven by said motor, and said probe unit is positioned just above said motor.

4. A wireless communications system according to claim 1 including;

means to measure the current injected into the earth as a measure of earth resistivity.

5. A wireless communications system according to claim 2 in which;

said optimal transmission frequencies are the frequencies that maximize the baud rate and distance and at which substantially error free data are received by said receiver.

6. A wireless communications system according to claim 1 in which;

said electromagnetic signals are encoded by frequency shift keying.

7. A wireless communications system according to claim 1 in which;

said electromagnetic signals are encoded by phase shift keying.

8. A wireless communications system according to claim 1 including;

an electromagnetic-signal-receiving antenna positioned at the earth surface and connected to said receiver-demodulator.

9. A wireless communications system according to claim 1 including;

an electromagnetic-signal-receiving antenna electrically connected to said drill string and connected to said receiver-demodulator.

10. A wireless communications system according to claim 1 including;

mathematical processing means, said data collecting means includes sensors for measuring selected conditions, and said receiver-demodulator decodes transmitted data and transmits the decoded data to said mathematical processing means to derive selected information therefrom.

11. A wireless communications system according to claim 10 in which;

said mathematic processing means processes the decoded data to determine x, y, and z hole coordinates and derive hole position vectors.

12. A wireless communications system according to claim 10 in which;

said sensors comprise accelerometers to measure the earth's gravity vector and fluxgate magnetometers to read the earth's magnetic field, and including power line proximity sensors.

13. A wireless communications system according to claim 10 in which;

said sensors includes three mutually orthogonal accelerometers to measure the earth's gravity vector and three mutually orthogonal fluxgate magnetometers to read the earth's magnetic field as well as any other DC and AC fields generated by energized cables or magnetic objects.

14. A wireless communications system according to claim 2 including;

a microprocessor controlling said frequency synthesizer to determine the frequencies generated, said receiver-demodulator includes a plurality of band-pass filters which can be activated selectively to match the frequencies sent by the frequency synthesizer, whereby optimum frequencies can be selected based on at least one of the criteria: (a) signal strength, (b) signal-to-noise ratio, (c) baud rate required, (d) transmission update rate, (e) planned transmission distance and (f) power management factors, and transmitting the optimum frequencies thus determined to said microprocessor to direct said frequency synthesizer to produce said optimum frequencies.

15. A wireless communications system according to claim 1 including;

an automatic gain control circuit to process the wide dynamic range of received signal strength and protect said receiver-demodulator against overload or becoming saturated by signal or noise.

16. A wireless communications system according to claim 14 in which;

said automatic gain control circuit includes a level detector determining amplitude of received signal and outputing a proportional control voltage and a voltage-controlled amplifier amplifying or attenuating the received signal in inverse proportion to the control voltage from said detector.

17. A wireless communications system according to claim 1 in which;

said data collecting means includes three mutually orthogonal accelerometers to measure the earth's gravity vector and three mutually orthogonal fluxgate magnetometers to read the earth's magnetic field as well as any other DC and AC fields generated by energized cables or magnetic objects, and including means to support said accelerometers and magnetometers against physical shocks encountered during drilling.

18. A wireless communications system according to claim 17 in which;

said shock absorbing means comprises a mandrel positioned linearly in said probe on which said accelerometers and magnetometers are mounted, and shock mounts at each end of said mandrel to protect said accelerometers and magnetometers against physical shocks encountered during drilling.

19. A wireless communications system according to claim 18 in which;

said shock mounts are blocks of fine-celled, low compression set, high density polyurethane foam.

20. A wireless communications system according to claim 1 in which;

said probe unit includes a battery pack and printed circuit board, a linearly positioned mandrel on which said battery pack and printed circuit board are supported, and shock mounts for said battery pack and printed circuit board supporting mandrel.

21. A wireless communications system according to claim 20 in which;

said battery pack and printed circuit board supporting mandrel shock mounts are surrounding O-rings providing radial cushioning and allowing torsional movement and end shock absorbers comprising blocks of fine-celled, low compression set, high density polyurethane foam to protect against axial loads.

22. A wireless communications system according to claim 1 including;

a ground ring surrounding part of said probe element to contact the earth and insulate the probe from contact with said drill string to facilitate transmission of the signal from said transmitter means to said receiver-demodulator.

23. A wireless communications system according to claim 22 in which;

the exterior surface of said probe unit has an insulating coating to insulate the probe from contact with said drill string.

24. A wireless communications system according to claim 1 including;

a portable computer connected to said receiver-demodulator and software run by said computer to compute both magnetic and gravity tool face data for display to the user.

25. A wireless communications system according to claim 1 including;

a portable computer connected to said receiver-demodulator and software run by said computer to compute both magnetic and gravity tool face data and display the one selected by the user, said data collecting means includes means for determining gravity vectors and earth's magnetic field, and said computer is operable to decode and mathematically process the transmitted data to determine x, y, and z hole coordinates and derive hole position vectors.

26. A wireless communications system according to claim 25 in which;

said data collecting means includes accelerometers to measure the earth's gravity vector and fluxgate magnetometers to read the earth's magnetic field and also function as power line proximity sensors.

27. A wireless communications system according to claim 25 in which;

said data collecting means includes three mutually orthogonal accelerometers to measure the earth's gravity vector and three mutually orthogonal fluxgate magnetometers to read the earth's magnetic field as well as any other DC and AC fields generated by energized cables or magnetic objects.

28. A wireless communications system according to claim 25 in which;

said data collecting means includes three mutually orthogonal accelerometers to measure the earth's gravity vector and three mutually orthogonal fluxgate magnetometers to read the earth's magnetic field as well as any other DC and AC fields generated by energized cables or magnetic objects, said computer is operable to decode and mathematically process the transmitted data according to the equations:

$$\text{INCLINATION} = \text{TAN}^{-1}\frac{\sqrt{G_x^2 + G_y^2}}{G_z}$$

$$\text{AZIMUTH} = \text{TAN}^{-1}\frac{\sqrt{G_x^2 + G_y^2 + G_Z^2}\,(H_xG_y - H_yG_x)}{H_z(G_x^2 + G_y^2) + H_xG_xG_z + H_yG_yG_z}$$

$$\text{TOOL FACE} = \text{TAN}^{-1}\frac{G_x}{G_y}\ \text{(Gravity)}$$

$$= \text{TAN}^{-1}\frac{H_x}{H_y}\ \text{(Magnetic)}$$

to determine x, y, and z hole coordinates and derive hole position vectors for locating the drilling motor and controlling the direction of drilling.

29. A wireless communications system for two way communication along an electrical lossy, single conductor extending into or along the earth surface with the earth forming the electrical return path, the system comprising;

a probe unit, supported adjacent to a distal end of said lossy, including means for collecting data, a microprocessor-controlled frequency synthesizer for producing frequencies in the range from 15 Hz to 100 kHz for transmission of data, transmitter means for encoding data from said data collection means into an electromagnetic signal generated by said frequency synthesizer in the form of simultaneously encoded multiple frequencies impressed simultaneously on said lossy single conductor, and a receiver-demodulator located at the proximal end of said lossy receiving and decoding a signal from said encoded multiple frequencies from said transmitter means.

30. A wireless communications system according to claim 29 including;

means responsive to local conditions around said lossy for directing said frequency synthesizer to transmit at the optimal transmission frequencies for transmitting selected information.

31. A wireless communications system according to claim 29 including;

means to measure the current injected into the earth and calculate the earth resistivity therefrom.

32. A wireless communications system according to claim 30 in which;

said optimal transmission frequencies are the frequencies that maximize the baud rate and distance and at which substantially error free data are received by said receiver.

33. A wireless communications system according to claim 29 in which;

said electromagnetic signals are encoded by frequency shift keying.

34. A wireless communications system according to claim 29 in which;

said electromagnetic signals are encoded by phase shift keying.

35. A wireless communications system according to claim 30 including;

an electromagnetic-signal-receiving antenna positioned at a proximal end of said lossy and connected to said receiver-demodulator.

36. A wireless communications system according to claim 29 including;

an electromagnetic-signal-receiving antenna electrically connected to said lossy and connected to said receiver-demodulator.

37. A wireless communications system according to claim 29 including;

mathematical processing means, said data collecting means includes sensors for measuring selected conditions, and said receiver-demodulator decodes transmitted data and transmits the decoded data to said mathematical processing means to derive selected information therefrom.

38. A wireless communications system according to claim 30 including;

a microprocessor controlling said frequency synthesizer to determine the frequencies generated, said receiver-demodulator includes a plurality of band-pass filters which can be activated selectively to match the frequencies sent by the frequency synthesizer, whereby an optimum frequency can be selected based on at least one of the criteria: (a) signal strength, (b) signal-to-noise ratio, (c) baud rate required, (d) transmission update rate, (e) planned transmission distance and (f) power management factors, and transmitting the optimum frequency thus determined to said microprocessor to direct said frequency synthesizer to produce said optimum frequency.

39. A wireless communications system according to claim 29 including;

an automatic gain control circuit to process the wide dynamic range of received signal strength and protect said receiver-demodulator against overload or becoming saturated by signal or noise.

40. A wireless communications system according to claim 38 in which;

said automatic gain control circuit includes a level detector determining amplitude of received signal and outputing a proportional control voltage and a voltage-controlled amplifier amplifying or attenuating the received signal in inverse proportion to the control voltage from said detector.

41. A wireless communications system according to claim 29 including;

a portable computer connected to said receiver-demodulator and software run by said computer to compute data and display the one selected by the user.

* * * * *